US007462587B2

(12) United States Patent
Shah et al.

(10) Patent No.: US 7,462,587 B2
(45) Date of Patent: Dec. 9, 2008

(54) COMPOSITION FOR REMOVING A FILM FROM A SUBSTRATE, A METHOD OF REMOVING A FILM FROM A SUBSTRATE, AND A METHOD OF MAKING THE COMPOSITION

(75) Inventors: Manesh Shah, Bloomfield Hills, MI (US); Thomas Cherniak, Royal Oak, MI (US); Gregory Work, Ypsilanti, MI (US)

(73) Assignee: General Chemical Corp, Brighton, MI (US)

( * ) Notice: Subject to any disclaimer, the term of this patent is extended or adjusted under 35 U.S.C. 154(b) by 205 days.

(21) Appl. No.: 10/834,569

(22) Filed: Apr. 29, 2004

(65) Prior Publication Data

US 2005/0245412 A1 Nov. 3, 2005

(51) Int. Cl.

| | |
|---|---|
| ***C11D 1/00*** | (2006.01) |
| ***C11D 3/20*** | (2006.01) |
| ***C11D 3/26*** | (2006.01) |
| ***C11D 3/39*** | (2006.01) |
| ***C11D 3/395*** | (2006.01) |

(52) U.S. Cl. ..... 510/206; 510/202; 510/212; 510/372; 510/499; 510/500; 510/505; 510/506

(58) Field of Classification Search ..... None
See application file for complete search history.

(56) References Cited

U.S. PATENT DOCUMENTS

| | | | | |
|---|---|---|---|---|
| 4,594,111 | A | 6/1986 | Coonan | 134/3 |
| 4,927,556 | A | 5/1990 | Pokorny | 252/173 |
| 4,956,115 | A | 9/1990 | Van De Mark | 252/170 |
| 5,006,279 | A | 4/1991 | Grobbel et al. | 252/542 |
| 5,085,795 | A | 2/1992 | Narayanan et al. | 252/162 |
| 5,098,591 | A | 3/1992 | Stevens | 252/162 |
| 5,098,594 | A | 3/1992 | Doscher | 252/162 |
| 5,106,525 | A | 4/1992 | Sullivan | 252/162 |
| 5,215,675 | A | 6/1993 | Wilkins et al. | 252/100 |
| 5,721,204 | A | 2/1998 | Maxwell et al. | 510/206 |
| 5,830,836 | A | 11/1998 | Smith et al. | 510/212 |
| 5,954,890 | A | 9/1999 | Smith et al. | 134/38 |
| 6,096,699 | A * | 8/2000 | Bergemann et al. | 510/201 |
| 6,165,962 | A * | 12/2000 | Kaler et al. | 510/365 |
| 6,200,940 | B1 | 3/2001 | Vitomir | 510/206 |
| 6,284,720 | B1 * | 9/2001 | Opre | 510/170 |
| 6,348,107 | B1 | 2/2002 | Whitton et al. | 134/38 |
| 6,479,445 | B1 * | 11/2002 | Machac et al. | 510/206 |
| 6,960,266 | B1 * | 11/2005 | Schaefer | 134/38 |
| 2002/0111284 | A1 * | 8/2002 | Machac et al. | 510/245 |
| 2002/0198124 | A1 | 12/2002 | Machac, Jr. et al. | 510/201 |
| 2004/0142830 | A1 * | 7/2004 | Tavares | 510/118 |

* cited by examiner

*Primary Examiner*—Gregory R Del Cotto

(57) ABSTRACT

Disclosed is a composition for removing a film from a substrate. The composition comprises a mixture comprising a water-soluble biodegradable alkyl ester, and a water insoluble biodegradable alkyl ester. Also disclosed is a method of removing a film from a substrate, comprising providing a coated substrate comprising a film adhered to a substrate; applying a composition comprising a mixture comprising a water-soluble biodegradable alkyl ester, and a water insoluble biodegradable alkyl ester to a surface of the coated substrate; leaving the applied composition in contact with the coated substrate for a time sufficient to create a portion of disengaged film; and removing the portion of disengaged film from the substrate. The composition also provides a method of making the disclosed composition, comprising mixing together an aqueous phase comprising a water soluble biodegradable alkyl ester, and a nonaqueous but water soluble phase comprising a water insoluble biodegradable alkyl ester.

37 Claims, No Drawings

COMPOSITION FOR REMOVING A FILM FROM A SUBSTRATE, A METHOD OF REMOVING A FILM FROM A SUBSTRATE, AND A METHOD OF MAKING THE COMPOSITION

FIELD OF THE INVENTION

The invention relates to compositions and methods for the removal of films from substrates and especially to the removal of films such as paints and coatings. More particularly, the invention relates to compositions comprising a mixture of a water-soluble biodegradable alkyl ester and a water insoluble biodegradable alkyl ester.

BACKGROUND OF THE INVENTION

It is often desirable to coat substrates with protective and/or decorative films resulting from the application and/or curing of various compositions. Such protective and/or decorative films may be thermoplastic or thermoset films, and may be uncured, partially cured or completely cured. Illustrative compositions include paints, coatings, primers, varnishes, adhesives, sealants, lacquers, polymers and the like. Illustrative substrates include metal substrates, plastic substrates, natural substrates such as wood, stone, concrete, and the like, as well as combinations thereof. In many instances, it is mandatory that the film strongly adhere to the substrate, typically by one or more of a chemical, mechanical, and/or covalent bonding mechanism.

However, while strongly adherent films are typically required, it is often necessary at some point to remove a previously applied film from a substrate. Removal may be desirable either before or after the applied film has been completely cured and may occur either sooner or longer after application to a substrate. In the case of the removal of a completely cured film from a substrate, it is often necessary to break or damage a three-dimensional cross-linked matrix.

Compositions used to remove films from substrates are known in the industry and are often referred to as paint removers, paint strippers, paint removing compositions, paint stripping compositions, and the like, and are collectively referred to herein as 'film removing compositions'. Film removing compositions commonly used in the industry have traditionally included 'active ingredients' such as methylene chloride (MCL), dimethyl sulfoxide (DMSO), N-methylpyrrolidone (NMP), phenols, acids, caustics, and combinations of one or more of such materials. Unfortunately, these known 'active ingredients' have been associated with certain disadvantages.

For example, although MCL containing compositions are a common and cost-effective film removing composition from a material standpoint, they are undesirable given the fact that MCL is volatile and regulated by state and/or federal agencies. Concerns have also been raised with respect to the toxicity, safety and ease of handling of materials such as MCL, phenols, caustics and acids. Materials such as caustics and acids can also attack the underlying substrate during the film removal process and result in undesirable substrate damage. Materials such as DMSO and NMP have been known to show inadequate efficacy at ambient conditions and are sometimes subject to regulatory and reporting requirements. Finally, film removal compositions containing one or more of these 'active ingredients' have been known to exhibit limited stability over time.

Thus, film removing compositions are disadvantageous when they are associated with one or more concerns relating to safety, toxicity, volatility, handling, substrate damage, efficiency, cost, stability, and the like. Numerous attempts to address and minimize such concerns have been made by the prior art.

For example, U.S. Pat. No. 3,954,648 discloses liquid compositions for removing coatings from coated metal surfaces. The liquid compositions are comprised of from one-fourth to about 10% by weight of an alkali metal hydroxide, from 40 to about 60% by weight of at least one high boiling oxygenated solvent and from 40 to about 60% by weight of at least one high boiling amine.

U.S. Pat. No. 4,508,634 discloses compositions suitable for removing paint, grease, dirt, and other foreign materials from the skin. The compositions comprise propylene carbonate, water, at least one organic cosolvent that can be an ester of an aliphatic monobasic or dibasic acid, at least one thickening agent, at least one neutralizing agent, and at least one surfactant.

U.S. Pat. No. 4,594,111 discloses a liquid phase cleaner-solvent consisting essentially of from about 50% to about 90% by weight of water, less than 10% by weight of sodium chloride, from about ½ to 1% to about 10% by weight of coconut amide, from about ½ of 1% to about 8% by weight of a tall oil fatty acid, from about 1% to about 15% by weight of isopropyl alcohol and from about 5% to about 40% by weight of propylene carbonate and a process for removing oxidation from metal surfaces using the liquid phase cleaner-solvent.

U.S. Pat. No. 4,927,556 discloses a composition for removing coatings from surfaces consisting essentially of at least one dibasic ester, water, and at least one thickening agent.

U.S. Pat. No. 4,956,115 discloses aqueous stripper compositions comprising water, trioxane, a surfactant and optionally a mixture of cosolvents comprising an aliphatic alcohol, an ester of an aliphatic carboxylic acid and an aromatic hydrocarbon or minimally hetero-substituted derivative thereof. The amount of the organic cosolvent is limited to about 30 wt. % to provide a stripper composition that is less volatile and more biodegradable than conventional stripper compositions.

U.S. Pat. No. 5,106,525 discloses water-soluble coating remover compositions comprising γ-butyrolactone, an organic acid, and water, and optionally include solvents, surfactants, thickeners, and rust inhibitors. The coating removers of the invention are said to be uniquely effective in that they are both water rinse able and capable of removing highly crosslinked coatings.

U.S. Pat. No. 5,215,675 discloses water-soluble stripping compositions containing a solution of water, a water soluble ester containing from 4 to 10 carbon atoms and an amount of hydrogen peroxide or compounds which generate hydrogen peroxide in situ; which peroxide concentration is not in excess of 30 wt. % of the water/ester composition.

U.S. Pat. No. 6,348,107 discloses a paint stripper for use by immersion of a painted substrate in a bath of the composition or application in place that has two phases, one aqueous and the other of partially water soluble organic solvent. The aqueous phase is saturated with organic solvent. The organic solvent is preferably benzyl alcohol, a dibasic ester or ethyl-e-ethoxypropionate; the total amount of organic solvent in the bath is suitably in the range of 2 to 20%.

U.S. Patent Application Publication No. U.S. 2002/0198124 discloses methods and compositions for the removal of coatings such as paint from surfaces. The disclosed methods are typically conducted between about 45° and about 75° C., and the compositions typically contain a carbonate, a dibasic ester, a pyrrolidine and a monoester.

It can be seen that attempts by the prior art to provide improved film removing compositions have not been wholly successful. It would therefore be desirable to provide a film removing composition that is free of one or more of concerns relating to safety, toxicity, volatility, handling, substrate damage, efficiency, cost, stability, and the like. It would be particularly desirable to provide a film removing composition that is associated with reduced concern in several of these areas. It would be especially desirable to provide an aqueous film removing composition that exhibits one or more improvements in volatility, toxicity, substrate damage, safety and handling, but is also advantageous with respect to stability, cost, and effectiveness.

SUMMARY OF THE INVENTION

In one exemplary embodiment, the disclosed composition for removing a film from a substrate comprises a mixture comprising a water-soluble biodegradable alkyl ester and a water insoluble biodegradable alkyl ester. In one especially exemplary embodiment, the water-soluble biodegradable alkyl ester comprises an alkyl lactate having an alkyl group of from one to three carbons and the water insoluble biodegradable alkyl ester comprises an alkyl soyate having an alkyl group of from one to fifteen carbons.

In another embodiment, the composition for removing a film from a substrate comprises a mixture comprising a water soluble biodegradable alkyl ester and a water insoluble biodegradable alkyl ester; an activated alcohol; a peroxide; a terpene; and at least one member selected from a group consisting of surfactants, chelating agents, cosolvents, peroxide stabilizers, corrosion inhibitors, evaporation retardants, thickening agents, activators, and mixtures thereof.

In yet another embodiment, the disclosed composition for removing a film from a substrate, comprises a mixture comprising a water-soluble biodegradable alkyl ester comprising an alkyl lactate having an alkyl group of from one to three carbons and a water insoluble biodegradable alkyl ester comprising an alkyl soyate having an alkyl group of from one to fifteen carbons; a substituted or unsubstituted aromatic alcohol; a peroxide; a terpene; a surfactant; a thickening agent; a cosolvent; and an activator.

Also disclosed is a method of removing a film from a substrate. The method comprises providing a coated substrate comprising a film adhered to a substrate; applying a composition comprising a mixture comprising a water-soluble biodegradable alkyl ester and a water insoluble biodegradable alkyl ester to the surface of the coated substrate; leaving the applied composition in contact with the coated substrate for a time sufficient to create a at least a portion of the film that is disengaged from the substrate, and removing the portion of the film that is disengaged from the substrate.

Finally, the invention also provides a method of making a composition for removing a cured film from a substrate, the method comprising mixing together an aqueous phase comprising a water soluble biodegradable alkyl ester, and a non-aqueous but water soluble phase comprising a water insoluble biodegradable alkyl ester.

DETAILED DESCRIPTION OF THE INVENTION

In one exemplary embodiment, the disclosed composition for removing a film from a substrate comprises a mixture comprising a water-soluble biodegradable alkyl ester and a water insoluble biodegradable alkyl ester. It has unexpectedly been found that the use of a mixture comprising a water-soluble biodegradable alkyl ester and a water insoluble biodegradable ester provides improved film removing properties, even in the absence of other compounds or materials having film removing properties.

The term 'biodegradable' as used herein refers to a substance that can be broken down into simpler substances by microorganisms such as molds, bacteria and the like.

Water-solubility and water insolubility as used herein refers to the solubility of the respective biodegradable alkyl ester in water. Solubility as used herein refers to the maximum amount of the respective biodegradable alkyl ester that can be dissolved in given quantity of water at a given temperature. Solubility is generally expressed as the number of grams of solute in one liter of saturated solution, i.e., for example, 12 g/L at 25° C. Solubilities can be broken into four general classes: soluble, slightly soluble, sparingly soluble, and insoluble. Sparingly soluble materials have very low solubilities such as 0.5 g per liter or (much) lower. At least one of the two biodegradable alkyl esters must be soluble in water, while the other biodegradable alkyl ester must be insoluble. In one exemplary embodiment, at least one of the two biodegradable alkyl esters will be infinitely soluble in water, while the other biodegradable alkyl ester will be insoluble in water.

The term 'alkyl ester' as used herein generally refers to compounds of the formula $[R_xO(O)C]_aR_y$, wherein a may be a number of from 1 to 3, preferably from 1 to 2 and most preferably 1, $R_x$ may generally be an alkyl group of at least one carbon, and $R_y$ may be a saturated or unsaturated, branched or unbranched, aliphatic or cycloaliphatic group of one or more carbons that may or may not contain heteroatoms such as O, N and the like. In one embodiment, $R_y$ may contain functional groups such as hydroxyl groups, amino groups, and the like. Such alkyl esters may be generally derived from a carboxylic acid containing compound of the general formal $R_yCOOH$, and an alkyl alcohol ($R_x$—OH) wherein $R_x$ and $R_y$ are as described above wherein the ester group is formed via the formal loss of water from an acidic hydroxy group of the former and a hydroxy group of the latter. In another exemplary embodiment, $R_x$ and $R_y$ will not be the same.

In one exemplary embodiment, both the water-soluble biodegradable alkyl ester and the water insoluble biodegradable ester will be characterized by being substantially free of any unsaturated groups and any branching in either $R_x$ or $R_y$.

In one embodiment, the water-soluble biodegradable alkyl ester will have a number average molecular weight of at least 80. In another embodiment, the water-soluble biodegradable alkyl ester will have a number average molecular weight of no more than 175. In one exemplary embodiment, the water-soluble biodegradable alkyl ester will have a number average molecular weight of from 80 to 150, more preferably from 120 to 130 and most preferably from 80 to 115.

In one exemplary embodiment, the water-soluble biodegradable alkyl ester will be of the structure: $[R_xO(O)C]_aR_y$, wherein a is as described above, $R_x$ is an saturated, aliphatic group of from one to three carbons, more preferably from one to two carbons, and most especially two carbons, and $R_y$ is a saturated, aliphatic group of from one to ten carbons, more preferably from 1 to 6 carbons and most especially from 2 to 4 carbons. In one exemplary embodiment, $R_y$ will contain one or more functional groups that improve water solubility such as hydroxy groups, amino groups, acid groups, and the like. It will be appreciated that the number of carbons in $R_y$ may increase with the presence of one or more functional groups that increase water solubility. For example, when $R_y$ is a linear aliphatic group that is free of any additional functional groups, $R_y$ will generally have from one to four carbons, preferably from one to three carbons, and most preferably from one to two carbons. However, when a is more than one or $R_y$ contains one or more acid, hydroxyl or amine groups, $R_y$ may generally have from one to eight carbons, preferably from one to six carbons, and most preferably from two to four carbons.

Illustrative examples of water-soluble biodegradable alkyl esters include alkyl esters of acid functional compounds such as monoacids, diacids, triacids, polyfunctional acids, and mixtures thereof. Illustrative acids include carboxylic acids, hydroxy acids, amino acids, and the like. In one embodiment, the water-soluble biodegradable alkyl ester will be an alkyl ester of a hydroxy or amino functional acid having one or acid groups. In one exemplary embodiment, the water-soluble biodegradable alkyl ester will be an alkyl ester of a hydroxy functional monocarboxylic acid.

Suitable carboxylic acids include formic acid, acetic acid, propanoic acid, and butanoic acid, with formic and acetic acid being especially suitable. Suitable hydroxy acids include glycolic acid, lactic acid, malic acid, citric acid, tartaric acid, and the like. Lactic acid, malic acid and citric acid are preferred, with lactic acid being especially preferred. Suitable amino acids include glutamic acid and aspartic acid. Mixed acids such as serine and threonine may also be suitable.

It will be appreciated that the water-soluble biodegradable alkyl esters may be formed from the acid esterification of such acids with alkyl alcohols. Illustrative alkyl alcohols are those having from one to three carbons, with methyl and ethyl alcohols being preferred and ethyl alcohol being used in one exemplary embodiment.

In one exemplary embodiment, the water-soluble biodegradable alkyl ester will be an alkyl ester of a hydroxy acid such as lactic acid wherein the alkyl alcohol has from 1 to three carbons. In one exemplary embodiment, illustrative water-soluble biodegradable alkyl esters include methyl lactate, ethyl lactate, and propyl lactate. In another exemplary embodiment, the water-soluble biodegradable alkyl ester will be at least one of methyl lactate or ethyl lactate. In one particularly exemplary embodiment, the water-soluble biodegradable alkyl ester will be ethyl lactate.

In addition to the water-soluble biodegradable alkyl ester, the mixture used in the instant film removing composition will also comprise a water insoluble biodegradable alkyl ester. In general, suitable water insoluble biodegradable alkyl esters will have a number average molecular weight of at least 104. In another embodiment, the water insoluble biodegradable alkyl ester will have a number average molecular weight of no more than 450. In one exemplary embodiment, the water insoluble biodegradable alkyl ester will have a number average molecular weight of from 200 to 450, more preferably from 200 to 310. In another exemplary embodiment, the water in soluable alkyl esters will have a number average molecular weight of from 372 to 404.

In one exemplary embodiment, the water insoluble biodegradable alkyl ester will be of the structure: $[R_xO(O)C]_aR_y$, wherein a is as described above, $R_x$ is an aliphatic group of from one to fifteen carbons, more preferably from one to five carbons, and most especially from one to three carbons, and $R_y$ is the residual of a fatty acid oil. It will be appreciated that in one exemplary embodiment, the water insoluble biodegradable alkyl ester will result from the esterification of the fatty acid oil with an alkyl alcohol.

Illustrative fatty acid oils include naturally derived oils such as vegetable oils, animal based oils, fish oils, and mixtures thereof. In one exemplary embodiment, the fatty oil that is esterified to produce the water insoluble biodegradable alkyl ester will be a vegetable oil. Suitable vegetable oils include soybean oil, corn oil, sunflower oil, rape seed oil, castor oil, and the like. In one exemplary embodiment, the vegetable oil will be soybean oil.

It will therefore be appreciated that the $R_y$ group of the water insoluble biodegradable alkyl ester may be saturated or unsaturated, and branched or unbranched. In one exemplary embodiment, $R_y$ will be substantially free of unsaturation throughout. In another embodiment, $R_y$ will be substantially free of branching at the end of the carbon chain.

In one embodiment, $R_y$ will have at least two carbons. In another embodiment, $R_y$ will have up to thirty-six carbons. In one exemplary embodiment, $R_y$ will have from eight to thirty-six carbons, more preferably from ten to twenty-two carbons, and most preferably from twelve to eighteen carbons. In one especially exemplary embodiment, $R_y$ will have sixteen carbons.

Suitable alkyl alcohols that may be used in the production of the water insoluble biodegradable alkyl ester include those having alkyl groups of from one to fifteen carbons. Suitable alkyl groups include methyl, ethyl, butyl, propyl, pentyl, and the like.

In one exemplary embodiment, illustrative water insoluble biodegradable alkyl esters include methyl soyate, ethyl soyate, methyl and ethyl esters of corn oil, methyl and ethyl esters of lard oil, and mixtures thereof. In another exemplary embodiment, the water insoluble biodegradable alkyl ester will be at least one of methyl soyate, ethyl soyate, the methyl ester of corn oil, the ethyl ester of corn oil, and mixtures thereof. In one particularly exemplary embodiment, the water insoluble biodegradable alkyl ester will be methyl soyate.

The mixture of the water-soluble and water insoluble biodegradable alkyl esters may generally comprise from 99 to 1 percent by weight of the water insoluble biodegradable alkyl ester and from 1 to 99 percent by weight of the water-soluble biodegradable alkyl ester, based on the total weight of the mixture. In one embodiment, the mixture of the water-soluble and water insoluble biodegradable alkyl esters may generally comprise at least 40% by weight of the water insoluble biodegradable alkyl ester and no more than 60% by weight of the water-soluble biodegradable alkyl ester, based on the total weight of the mixture. In another embodiment, the mixture of the water-soluble and water insoluble biodegradable alkyl esters may generally comprise from 40 to 90 percent by weight of the water insoluble biodegradable alkyl ester and from 10 to 60 percent by weight of the water-soluble biodegradable alkyl ester, based on the total weight of the mixture. In one especially exemplary embodiment, the mixture of the water-soluble and water insoluble biodegradable alkyl esters may generally comprise from 60 to 80 percent by weight of the water insoluble biodegradable alkyl ester and from 20 to 40 percent by weight of the water-soluble biodegradable alkyl ester, based on the total weight of the mixture.

The film removing compositions disclosed herein will generally comprise the mixture of the two biodegradable alkyl esters in an amount of at least 1 weight %, based on the total weight of the film removing composition. In another embodiment, the instant film removing compositions will comprise the mixture of the two biodegradable alkyl esters in an amount of no more than 99 weight %, based on the total weight of the film removing composition. In one exemplary embodiment, the instant film removing compositions will comprise the mixture of the two biodegradable alkyl esters in an amount of from 5 to 30 weight %, based on the total weight of the film removing composition, more preferably from 5 to 12 weight % and most preferably from 5 to 10 weight %, based on the total weight of the film removing composition.

The disclosed film removing compositions may include other components in addition to the mixture of the water-soluble and water insoluble biodegradable alkyl esters. In one exemplary embodiment, the film removing compositions may also include one or more of an activated alcohol, a peroxide or stabilized peroxide, a cosolvent, an activator, a penetrant, a surfactant, a thickening agent, and mixtures thereof.

An activated alcohol as used herein refers to an alcohol containing a carbon-carbon double bond or a conjugated system (such as phenyl group) at a position alpha to the hydroxylated carbon of the alcohol. Illustrative activated alcohols include substituted and unsubstituted aromatic alcohols such as benzyl alcohol and substituted benzyl alcohols containing an oxygen or amino group. In one exemplary embodiment, the activated alcohol will be at least one of benzyl alcohol, methyl benzyl alcohol, phenyl benzyl alcohol and mixtures thereof. In one especially exemplary embodiment, the activated alcohol will be benzyl alcohol.

The activated alcohol will generally be present in the composition in an amount of from 0 to 60% by weight, based on the total weight of the film removing composition. In another embodiment, the activated alcohol will be present in an amount of no more than 30% by weight, based on the total weight of the film removing composition. In one exemplary embodiment, the activated alcohol will be present in an amount of at least 1% by weight, based on the total weight of the composition. In yet another embodiment, the activated alcohol will be present in the composition in an amount of from 1 to 20% by weight, based on the total weight of the composition. Finally, in a particularly exemplary embodiment, the activated alcohol will be present in the composition in an amount of from 2 to 10% by weight, based on the total weight of the composition.

The film removing composition may also comprise a peroxide compound that is a stabilized or unstabilized peroxide. The peroxide in the disclosed composition can be present as an aqueous solution of hydrogen peroxide or it can represent the amount of hydrogen peroxide generated in situ from a water soluble peroxy compound or complex such as for example polyvinylpyrrolidone-hydrogen peroxide, urea peroxide and the like which liberates hydrogen peroxide upon contact with water. Illustrative peroxide compounds that may be used include hydrogen peroxide, urea peroxide, carbamide peroxide, and the like. In one exemplary embodiment, the peroxide compound will be hydrogen peroxide.

The peroxide compound may be present in an amount of from 0 to 50% by weight. In another embodiment, the peroxide will be present in an amount of at least 1% by weight, based on the weight of the composition. In yet another embodiment, the peroxide will be present in an amount of from no more than 40% by weight, based on the weight of the composition. In one exemplary embodiment, the peroxide will be present in an amount of from 5 to 25% by weight, based on the weight of the composition.

The film removing composition may also optionally comprise, but preferably will comprise, one or more additional components that are at least one of penetrants, surfactants, chelating agents, cosolvents, peroxide stabilizers, corrosion inhibitors, evaporation retardants, thickening agents, activators, and mixtures thereof. In one exemplary embodiment, the film removing composition will comprise one or more additional components that are at least one of a cosolvent, an activator, a penetrant, a surfactant, a thickening agent, and mixtures thereof. In another exemplary embodiment, the film removing composition will comprise at least one of each one of the following components: a cosolvent, an activator, a penetrant, a surfactant, and a thickening agent.

Illustrative cosolvents include water and water-soluble solvents. Illustrative cosolvents include propylene glycol, N-methylpyrrolidone and related pyrrolidones and pyrrolidines, propylene, ethylene or butylenes carbonate, dibasic esters including refined dimethyl, diethyl, dipropyl, diisopropyl or mixed esters (such as methyl, ethyl, propyl, isopropyl) of adipic, glutaric, succinic acids and mixture thereof) such as those commonly used in currently marketed biodegradable paint strippers, gamma-butyrolactone and other cyclic esters and related compounds, among others. Other suitable cosolvents include alkylene glycol ethers, such as triethylene glycol methyl ether, propylene glycol methyl ether, tripropylene glycol methyl ether, diethylene glycol ethyl ether, etc., propylene carbonate, alcohols and glycols, such as ethylene glycol, propylene glycol, cyclohexanol, tetrahydrofurfuryl alcohol etc., substituted lactams such as N-methyl-2-pyrrolidone; dimethyl imidiazolidinone, tetramethyl urea, glycol ether acetates such as ethylene butyl glycol acetate, and mixtures of the above diluents. Also, solvents having a hydrogen bonding value equal to, or approaching zero, e.g. dipentenes and $C_6$ to $C_{10}$ hydrocarbons are useful, particularly in admixture with N-methyl pyrrolidone.

These cosolvents may be added in amounts ranging from about 1% to about 70% by weight of the final composition, with a preferred weight range being about 5% to about 40% by weight, more preferably about 10% to about 30% by weight, based on the weight of the composition.

The film removing composition may also comprise an activator or coactivator. Illustrative activators include peroxides such as discussed above, amines, acids, solvents as discussed above, and mixtures thereof. Activators can also be used with the peroxide compound to further boost the activity of the film removing composition. Such activators are acids having a $pK_a$ value less than 4, however, caution should be observed since these acids are corrosive to metal surfaces. Generally, not more than 25% of the activator is desirable in the film removing composition. In any case, the corrosive properties of these acids must be balanced against the benefits of faster striping. To avoid significant corrosion, it is recommended that less than 9% of the activator be employed if the film removing composition is used to remove a film from a metal substrate. Examples of suitable acid activators include hydroxyacetic acid, malic acid, glycolic acid, sulfuric acid, phosphoric acid, formic acid, and mixtures thereof. Buffers can be used in the above acid environment to control the pH to about 3-4.5 and thus minimize corrosive effects on metals and decrease the rate of ester hydrolysis while increasing the life of the film removing composition. Organoamines such as monoethanolamine, triethanolamine, morpholine, triethylamine, aminomethylpropanol, ethyl pyrrolidone, and the like or their mixtures may also be used.

In one exemplary embodiment, the activator or coactivator will be an acid functional material. A preferred activator is at least one of malic acid, hydroxyacetic acid, or the like. In embodiment, the activator will be hydroxyacetic acid.

The activators may be employed in amounts of from 0 to 20% by weight, based on the weight of the composition. In one embodiment, the activators may be present in an amount of from 1 to 10% by weight, based on the weight of the composition. In another embodiment, the activators may be present in an amount of from 2 to 5% by weight, based on the weight of the composition.

The film removing composition may also optionally comprise a surfactant. In one exemplary embodiment, the film removing composition will comprise a surfactant. For example, a water soluble surfactant in an amount between about 0.01 and about 10 weight % can be added to the basic composition so as to provide better wetting properties by lowering the surface tension of the formulation, thus insuring complete coverage and a more uniform coating on the coated substrate. The surfactant may also assist in removing and dislodging loosened coating particles during the stripping operation. Suitable surfactants include non-ionic, anionic, cationic or amphoteric types which include monocarboxyl cocoimidoazoline (e.g. ANTRON®), higher alkyl sulfate sodium salts (e.g. DUPONOL®), tridecyloxy poly(alkyleneoxy ethanol) (e.g. EMULPHOGENE®), ethoxylated or propoxylated alkyl phenol (e.g. IGEPAL®), alkyl sulfoamides (e.g. IGEPON®), $C_{10}$-$C_{18}$ alkaryl sulfonates (e.g. SANTOMERSE®), cocoamphodipropionate (e.g. MIRANOL®), cetylpalmitic alkanol amides (e.g. CENTROL®), hydrogenated castor oil (e.g. PARASYN®), isooctylphenyl polyethoxy ethanol (e.g. TRITON®), N—$C_8$ to $C_{18}$ alkyl pyrrolidone (e.g. SURFADONE®), polyalkoxylated fatty acid esters (e.g. TRYDET®), N-coco-ω-amino propionic acid and polyethoxy amino salts thereof, sodium alkylbenzene sulfonate and mixtures of the above, such as a mixture of sodium alkylbenzene sulfonate and SURFADONE®. Examples of other suitable surfactants are described by Cahn et al., "Surfactants and Detersive Systems", 1983, published by John Wiley & Sons in Kirk-Othermer's Encyclopedia of chemical Technology, 3rd Ed. (1983), pages 332-432.

In one embodiment, the film removing composition will also comprise a thickening agent. Such agents may be present in an amount of from 0 to 7.0% by weight, based on the total weight of the film removing composition, more preferably from 0.1 to 2.0% by weight, based on the total weight of the film removing composition. Thickening agents can be used to retain the composition on the coating surface for an extended contact time sufficient to loosen the coating. The thickeners employed are those that are stable with respect to peroxides. Examples of such additives include carboxy polymethylenes, thickeners of the cellulose type, e.g. hydroxypropyl cellulose (e.g. Klucel), hydroxy propyl methyl cellulose, ethyl cellulose, ethyl hydroxyethyl cellulose, methyl cellulose, colloidal silica, clays such as bentonite, starch, colloidal alumina, gum arabic, tragacanth, agar, acylic acid/1% polyallyl ether of sucrose (e.g. Carbopol 934 or 940), high molecular weight polyethylene oxides, polyoxyethylene-polyoxypropylene glycolblock copolymers, guar gum xanthan gum, polyvinylpyrrolidone and methyl vinyl ether/maleic anhydride copolymers. It is also to be understood that any of the above diluents can be added to lower the viscosity of the stripping composition for certain applications.

Of the above thickeners, those of the cellulose type are preferred and Klucel, containing repeating units of anhydroglucose

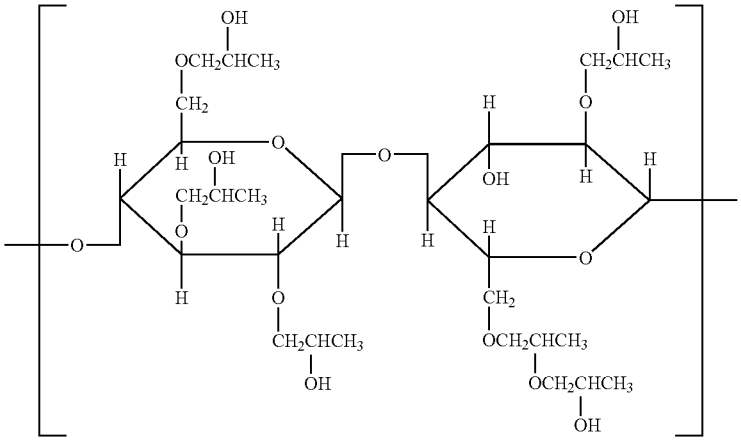

in which 4 or more of the hydroxyl groups are converted to ether or hydroxyalkyl groups, is particularly preferred. In one exemplary embodiment, the thickeners will be alkyl cellulose thickeners such as hydroxy propyl cellulose, hydroxy propyl methyl cellulose, and the like.

In one exemplary embodiment, the film removing composition will also comprise a penetrant. As used herein, the term penetrant refers to a class of acyclic and cyclic unsaturated compounds derived from natural essential oils and resins having at least 10 carbon atoms known as terpenes. Terpenes that find use in the present invention include alcohols and aldehydes as well as unsaturated hydrocarbons. Any number of terpene compounds, including combination of these terpenes may be used in the present invention as the base or primary solvent as polymer absorbents. Preferred terpene compounds are those compounds that have a $K_B$ value of at least about 108 (the same value as toluol, an aromatic hydrocarbon which is the solvent of choice in may prior art strippers) and a flash point above about 120° F.

$K_B$ is a measure of the solvency of a hydrocarbon. In general, the higher the $K_B$value, the greater the general solvent power of the hydrocarbon under test conditions described by ASTM D1133. To determine $K_B$ value, a hydrocarbon sample is added to a standard solution of kauri gum in butyl alcohol until sufficient kauri gum precipitates to blur vision of 10-point type viewed through the flask. When used in varnish, lacquer and enamel formulations, a hydrocarbon diluent with a high $K_B$ value dissolves relatively large quantities of solids.

The preferred terpene compounds for use in the present invention are represented by unsaturated hydrocarbons, alcohols and aldehydes having at least 10 carbon atoms and include 3,7-dimethyloctanol, alpha-pinene, beta-pinene, delta-3-carene, citronellal, citronellol, hydroxycitronellal, d-limonene, linalool, gamma-terpinesne, tetrahydrolinalool and terpineol, among others, with d-limonene being preferred.

Penetrants may be present in embodiments of the composition in amounts of from 0.1 to 5.0% by weight, based on the total weight of the film removing composition.

Other materials and components that may be optionally added to the film removing compositions disclosed herein include chelating agents, anti-corrosion agents, evaporation retardants, and the like. Chelating agents in an amount of between about 0.01 and about 10 weight % can also be added to the above composition when stripping metal surfaces so as to complex with metal ions which may cause degradation of the peroxide. Examples of such chelating agents include ethylene diamine tetraacetic acid (EDTA) and its metal salts, nitrilotriacetic acid and metal salts, diethylene triamine pentaacetic acid, polyphosphates, diketones, hydroxy carboxylic acids, and phosphonic acids, e.g. Dequest (available from Monsanto), and the like. Stabilizers for the hydrogen peroxide in an amount of between about 0.01 and about 1 weight % can also be added to extend the bath life of the composition when needed. Illustrative of these additives are $C_1$ to $C_4$ alkyl anilines, aromatic sulfonic acids, sulfamic acids, sulfones, sulfoxides, sulfolenes, sulfolanes, amino aryl sulfonic acid, benzene disulfonic acid, p-tolyl sulfonic acid, sulfanilic acid, propylene glycol, glycolic acid, glycerine, propionic acid, benzoic acid, cis-4-butenediol and the like or mixtures thereof.

To minimize corrosion of metal surfaces, certain corrosion inhibitors in an amount of from 0.1 to about 3 wt. % may also be included, examples of which are an ethoxylated butynediol, petroleum sulfonates (e.g. Alox™ 575), and blends of propargyl alcohol and thiourea, e.g. Rodine™ supplied by Henkel Chemical Inc. or Armohib™ supplied by Akzo Chemical Inc. For extending the life of the composition, evaporation retardants can be used in an amount between about 0.1 and about 5 weight % of the basic composition of which siloxane, stearic acid, a paraffinic wax or beeswax are examples.

The pH of the paint stripper compositions of the present invention may vary over a relatively wide range generally less than a pH of about 10-11. Preferred compositions generally have a pH ranging from about 2.5 to about 9.5, and most preferably have a neutral pH (about 5.5 to about 8.5). Certain paint strippers of the present invention which are to be used as industrial or military paint strippers may be quite alkaline, i.e., have a pH approaching 12.0 or more or have a pH which is quite acidic, i.e., about 2.5 or lower. In instances where a higher pH is desired, a base, preferably a biodegradable amine-containing base, is included in the film removing compositions. Exemplary amines included for the purpose of raising the pH of the composition include, for example, aminomethylpropanol, alkanol amines and related amine containing bases. Triethanolamine and ethanolamine, among other amine containing bases, may also be used to increase the pH of the compositions when necessary. Aminomethylpropanol, triethanolamine, ethanolamine and triethylamine are the preferred amine bases for inclusion in the present compositions, with aminomethylpropanol being especially preferred.

In cases where it is desired to have a low pH, for example a pH of about 3.5 or less, an acid may be added to the compositions according to the present invention. Preferred acids include the low pKa organic acids (pKa's generally less than about 3.0) such as hydroxy acetic acid, maleic acid, and other acids such as sulfamic acid and phosphoric acid, among others. In addition, in order to lower the pH of the composition for certain applications, an acidic phosphate ester surfactant among others, may also be added to the compositions.

The compositions according to the present invention, for routine paint and polymer removal, are preferably neutral in pH (about 5.5 to 8.5). It is an unexpected results that paint stripper compositions of the present invention show substantial paint stripping activity in the industrial setting within a neutral pH range. Thus, although an acidic or basic accelerator may be added to the disclosed film removing compositions to increase stripping efficiency and shorten stripping time, such an acidic or basic accelerator is often not necessary. In compositions to be used in the home by the consuming public, it is preferred to exclude acidic or basic accelerators.

The disclosed compositions may be made by a method comprising mixing together an aqueous phase comprising a water soluble biodegradable alkyl ester, and a nonaqueous but water soluble phase comprising a water insoluble biodegradable alkyl ester. A water soluble phase refers to the solvents discussed above, especially the activated alcohol.

In one embodiment, the film removing compositions may be formed as a water-in-oil emulsion that is stable at ambient environmental conditions. One useful method of making a water-in-oil emulsion is described below. A nonaqueous but water soluble phase is made of the water insoluble alkyl ester, the alcohol, and optionally the thickening agent. An aqueous phase is made of the water and the water soluble alkyl ester, and optionally, one or more of the penetrants, the chelating agent, the alkylene glycol, stabilized peroxide, and the activator. Other additives may be included in either phase. The aqueous phase is slowly dispersed in the water soluble phase as the mixture is stirred. After the aqueous phase is fully added, the mixing speed is increased so that the rheological modifier in the mixture is overcome; i.e., the viscosity of the mixture increases and forms a homogeneous mixture. Upon this occurring, the mixing speed is reduced to a constant speed. In an alternative and exemplary embodiment, the thickener may be made into a slurry with water and added to a mixture of the two phases.

In one embodiment, the nonaqueous phase is made by sequentially adding the water insoluble ester, the alcohol, and optionally the Theological agent. This phase is preferably blended for 45 minutes at 350-500 rpm. The aqueous phase is made by sequentially adding the water and the water soluble ester, and optionally one or more of the penetrants, the stabilized peroxide, the propylene glycol, the chelating agent and then the activating agent. The aqueous phase is also preferably blended for 45 minutes at 350-500 rpm. After the dispersion of the aqueous phase in the nonaqueous phase is completed, the blending speed is then increased to 1500-1700 rpm to create high shearing blending. The high shearing blending is preferably carried out until the aqueous phase folds into the nonaqueous phase to form an emulsion. This is indicated by a sudden increase in viscosity and swelling of the composition into a single phase; normally 5-15 minutes is adequate. After this point, the mixture will be blended at 1200 rpm for one hour. The material is left for a period of time to allow for the total uptake and dissolving of the rheological modifier. The composition is then reblended at 350-500 rpm for a period of 45 minutes to 1 hour. The composition resultant from this blending process is a viscous material capable of clinging to vertical and overhead surfaces for period of time sufficient to remove paint.

The disclosed method of making the instant composition is exemplified by the Examples 1, 2, 3, 4, and 5 below.

The film removing compositions disclosed herein may be used to remove a variety of films from a substrate, including both cured and uncured films. Illustrative films that may be removed by the instant film removing compositions include paints, coatings, primers, varnishes, adhesives, sealants, lacquers, polymers and the like, whether such films are uncured, partially cured or cured. Cured as used herein may refer to the degree of crosslinking when referring to thermosetting films or the degree of solvent evaporation when referring to non-crosslinking films such as lacquers.

Illustrative substrates include metal substrates, plastic substrates, natural substrates such as wood, stone, concrete, and the like, as well as combinations thereof. Examples of metal substrates that are stripped with the present composition include steel, aluminum, titanium, cadmium plated steel surfaces and other cladded or non-cladded metal surfaces. The composition, when administered to a coated surface, is generally applied in a thickness of from about ⅙" to about ¼" or in a thickness adequate to loosen the resinous coating as is consistent with dependent upon the chemical nature and thickness of the resinous coating. Also one or more applications of the film removing composition can be employed, when needed.

The film removing composition can be applied by spraying, dipping, brushing, wiping on the coating of a plastic, glass, wood or metal surface or the coated substrate can be immersed in the above composition for separation of the coating. In one embodiment, the film removing compositions of the present invention may be applied through conventional methods such as wiping the composition onto the surface to be stripped. The substrate containing the film to be removed may also be dipped in the film removing compositions. In one exemplary embodiment, the compositions are sprayed on to the film to be removed.

In one embodiment, the disclosed film removing composition may be used to remove a film by a method comprising providing a coated substrate comprising a film adhered to a substrate, applying a composition comprising a mixture comprising a water soluble biodegradable alkyl ester, and a water insoluble biodegradable alkyl ester to the surface of the coated substrate; leaving the applied composition in contact with the coated substrate for a time sufficient to create a at least a portion of the film that is disengaged from the substrate, and removing the portion of the film that is disengaged from the substrate.

The film removing composition will generally be left in contact with the film to be removed for a period of time sufficient to create at least a portion of the film that is disengaged from the substrate. In one embodiment, the composition will be left in contact with the film to be removed for a period of from 480 to 240 minutes at ambient temperature, more preferably from 120 to 90 minutes at ambient temperature, and most preferably from 60 to 30 minutes at ambient temperature. It will be appreciated however, that the length of time is only approximate and depends on the paint type and thickness of the film as well as the age of the film.

'Disengaged' as used herein refers to any break or interference in the mechanical and/or covalent bonding of the film to the substrate. In some cases, it may be possible to remove the disengaged film by wiping with a cloth or rinsing with a liquid such as water. In other cases, additional mechanical forces may need to be applied as with scuffing or scouring.

In one embodiment, the disengaged film and any remaining film removing composition is removed from the substrate through a water spray. Pressure enhancing equipment may or may not be used. The water spray need not scour the substrate to remove the paint. Rather, the water may be used to wash off disengaged film that is residually, yet tenuously, attached to the substrate. In addition, clean-up of the instant film removing compositions consists almost exclusively of filtering the paint residue from the resultant post-removal waste. This is because the disclosed composition does not dissolve the film being removed, but rather releases the film's hold on the substrate.

In another embodiment, light and/or heat energy may be introduced onto the substrate that contains the film removing composition and the film to be removed. Although the amount of light and/or heat energy may vary, in the case of the use of light energy, it has been found that the film removing or stripping activity of the composition increases as the amount of light energy applied to the film to be stripped is increased. Thus, the use of direct sunlight, or a UV lamp (preferably emitting UVB or alternatively, a combination of UVA and UVB light energy) that is held close to the surface of the polymer to be stripped or alternatively, is an intense source of light, may be advantageously employed in the present invention. The amount of light and/or heat energy applied to a surface is an effective amount for enhancing the stripping efficiency of the film removing compositions. One of ordinary skill in the art will readily recognize that the type and amount of light energy to be delivered to the surface containing the polymer to be removed and the stripping composition may vary according to the activity of the stripping composition, the amount of composition deposited onto the polymer surface to be removed and the relative degree of difficulty removing the polymer from the surface.

The film removing compositions may also be activated in the presence of heat energy. Heat energy may be introduced by any means, but is preferably introduced onto the surface of the coating to be stripped using a simple convection source. An infrared heat source may also be used. Alternatively, in the case of metallic or composite substrates that are heat conductors, it may be possible to heat the underlying surface directly (electronically or using heat coils, etc.). In general, when heat is used as an energy source, the paint stripping composition should attain a temperature of at least about 23.degree. C. (about 72.degree. F.), preferably at least about 32.degree. C. (about 90.degree. F.), more preferably at least abut 43.degree. C. (about 110.degree. F.). Preferably, the temperature should be no higher than about 63.degree. C. (about 145.degree. F.), because at temperatures above about 63.degree. C., solvent may begin to evaporate from the surface to be stripped, thus actually reducing the activity of the composition. As one increases the temperature of the composition and substrate to be stripped, the stripping activity and efficiency generally increase up to a point.

A combination of heat and light energy, as generally described hereinabove is a preferred method for stripping paint. One of ordinary skill will know to vary the temperature and the type and amount of light energy to which the polymer to be stripped and the paint stripping compositions according to the present invention are exposed in order to enhance and facilitate the removal of polymeric coatings using the paint stripping compositions according to the present invention.

The disclosed film removing compositions have several important advantages, including low toxicity and high efficacy in removing paint and coatings whether at an acidic, neutral, or basic pH. Because hydrogen peroxide decomposes over time to water, the disclosed film removing compositions are environmentally friendly, particularly as compared to prior art compositions used for paint and coating removal. Moreover, the thickened compositions of this invention are peroxide stable, retain their viscosity over time, and provide clean, miscible, solutions free of phase separation, cloudiness or flocculation. Because of the general absence of OSHA and EPA regulated compounds and the inherent safety of the composition, the person applying the compositions requires minimal safety equipment. Similarly, these compositions can be used in an unlimited fashion in enclosed spaces.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

All cited patents, patent applications, and other references are incorporated herein by reference in their entirety.

EXAMPLES

Example 1

A film removing composition according to the instant disclosure was prepared in the following manner. All percents by weight are based on the total weight of the film removing composition.

Part A

The following materials were added to a mixing tank in the listed order and mixed until uniform.

| PART B | |
|---|---|
| 1. Water | 19.3% by weight |
| 2. Propylene glycol | 4.0% by weight |
| 3. AMP-95 | 5.0% by weight |
| 4. Hydrogen peroxide 31%, stabilized | 5.0% by weight |
| 5. Ethyl lactate | 1.0% by weight |
| 6. Ethylan HB-4[1] | 1.0% by weight |
| 7. Berol TFR[2] | 1.0% by weight |

[1]Penetrant manufactured by Akzo Nobel.
[2]Surfactant blend manufactured by Akzo Nobel.
Thickener manufactured by Dow Chemical Co.

The following materials were added to a second mixing tank in the order listed and mixed until uniform.

| PART C | |
|---|---|
| 1. Benzyl alcohol | 39.0% by weight |
| 2. Methyl soyate | 4.7% by weight |

The following materials were added to a third mixing tank in the listed order, heated to 150 degrees F. and mixed until a slurry formed.

| | |
|---|---|
| 1. Water | 19.3% by weight |
| 2. Methocel F4M | 0.7% by weight |

Part A was mixed with medium agitation while part C was added. Mixing was continued for approximately five minutes and then stopped. Part B was then added slowly, followed by slow mixing of the resultant mixture. As the composition thickened, mixing speed was increased. The resulting film removing composition was mixed until thick and homogeneous.

The composition was applied to coated substrates individually coated with one of the following cured films: alkyd stain, alkyd semi-transparent stain, alkyd enamel, acrylic solid stain and acrylic semi-transparent stain. The substrates were wood panels and the cured films had a film thickness of approximately 1.5 mil. The coated substrates had been aged for three years. The composition was also applied to a sixth test panel of aluminum coated with 2 mils of a 2K polyurethane acrylic system cured at 110 F @ 9 hours and then left to cure for additional 2 weeks or more at ambient temperature.

Three grams of the film removing composition was spread in a one inch circle on each of the test panels at room temperature to provide a thickness of about 1.5 mil for the film removing composition.

Panels were examined at 15 minute intervals for lifting of the film and evaluated per the following rating system: exceptional: paint lifted in 15 minutes or less; very good: paint lifted in 15 to 30 minutes; good: paint lifted in 30 to 45 minutes; fair: paint lifted in 45 to 60 minutes; poor: paint lifted in 60 to 120 minutes; very poor: paint lifted in more than 120 minutes. The film removing composition exhibited exceptional removing efficiency on the test panels containing the following films: alkyd solid stain, alkyd semi-transparent stain, alkyd enamel, acrylic solid stain and acrylic semi-transparent stain. Very good stripping efficiency was shown on the test panel containing the 2K polyurethane acrylic film.

Comparative Example 1a

A comparative film removing composition was prepared according to the procedure of Example 1 and using the components of Table 1a.

TABLE 1a

| | |
|---|---|
| PART A | |
| Water | 19.3% by weight |
| Propylene Glycol | 4.0% by weight |
| AMP-95 | 5.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| Methyl Soyate | 4.7% by weight |
| PART C | |
| Water | 19.3% by weight |
| Methocel F4M | 0.7% by weight |

The comparative composition was evaluated as per Example 1 and exhibited very good stripping efficiency but required almost double the time to strip when compared to EXAMPLE 1 composition.

Comparative Example 1b

A comparative film removing composition was prepared according to the procedure of Example 1 and using the components of Table 1b.

TABLE 1b

| | |
|---|---|
| PART A | |
| Water | 21.1% by weight |
| Propylene Glycol | 4.0% by weight |
| AMP-95 | 5.0% by weight |
| Ethyl Lactate | 2.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| PART C | |
| Water | 21.1% by weight |
| Methocel F4M | 0.7% by weight |

The composition was evaluated as per Example 1. This composition exhibited good stripping efficiency but doubled the time to strip when compared to EXAMPLE 1 composition.

Comparative Example 1c

A comparative film removing composition was prepared according to the procedure of Example 1 and using the components of Table 1c.

TABLE 1c

| | |
|---|---|
| PART A | |
| Water | 22.1% by weight |
| Propylene Glycol | 4.0% by weight |
| AMP-95 | 5.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| PART C | |
| Water | 22.1% by weight |
| Methocel F4M | 0.7% by weight |

The composition was evaluated as per Example 1. This composition exhibited good stripping efficiency but more than doubled the time to strip when compared to EXAMPLE 1 composition.

Example 2

A second film removing composition according to the instant disclosure was prepared and evaluated per Example 1.

| | |
|---|---|
| PART A | |
| Water | 18.8% by weight |
| Propylene Glycol | 4.0% by weight |
| Triethanolamine 85% | 5.0% by weight |
| Ethyl Lactate | 2.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| Methyl Soyate | 4.7% by weight |

-continued

| | |
|---|---|
| PART C | |
| Water | 18.8% by weight |
| Methocel F4M | 0.7% by weight |

This composition exhibited stripping efficiency almost on par with EXAMPLE 1 composition; i.e. exceptional.

Comparative Example 2a

A comparative film removing composition was prepared according to the procedure of Example 1 and using the components of Table 2a.

TABLE 2a

| | |
|---|---|
| PART A | |
| Water | 19.8% by weight |
| Propylene Glycol | 4.0% by weight |
| Triethanolamine 85% | 5.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| Methyl Soyate | 4.7% by weight |
| PART C | |
| Water | 19.8% by weight |
| Methocel F4M | 0.7% by weight |

The composition was evaluated as per Example 1. This composition exhibited stripping efficiency comparable to Comparative Example 1a composition.

Comparative Example 2b

A comparative film removing composition was prepared according to the procedure of Example 1 and using the components of Table 2b.

TABLE 2b

| | |
|---|---|
| PART A | |
| Water | 21.1% by weight |
| Propylene Glycol | 4.0% by weight |
| Triethanolamine 85% | 5.0% by weight |
| Ethyl Lactate | 2.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| PART C | |
| Water | 21.1% by weight |
| Methocel F4M | 0.7% by weight |

The composition was evaluated as per Example 1. This composition exhibited stripping efficiency comparable to Comparative Example 1b composition.

Comparative Example 2c

A comparative film removing composition was prepared according to the procedure of Example 1 and using the components of Table 2c.

TABLE 2c

| | |
|---|---|
| PART A | |
| Water | 22.1% by weight |
| Propylene Glycol | 4.0% by weight |
| Triethanolamine 85% | 5.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| PART C | |
| Water | 22.1% by weight |
| Methocel F4M | 0.7% by weight |

The composition was evaluated as per Example 1. This composition exhibited stripping efficiency comparable to Comparative Example 1c composition.

Example 3

A third film removing composition according to the instant disclosure was prepared using the components of Table 3 and evaluated per Example 1.

| | |
|---|---|
| PART A | |
| Water | 18.8% by weight |
| Propylene Glycol | 4.0% by weight |
| Glycolic Acid | 5.0% by weight |
| Ethyl Lactate | 2.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| Methyl Soyate | 4.7% by weight |
| PART C | |
| Water | 18.8% by weight |
| Methocel F4M | 0.7% by weight |

This composition exhibited stripping efficiency comparable to Example 1 composition.

Comparative Example 3a

A comparative film removing composition was prepared according to the procedure of Example 1 and using the components of Table 3a.

TABLE 3a

| | |
|---|---|
| PART A | |
| Water | 19.8% by weight |
| Propylene Glycol | 4.0% by weight |
| Glycolic Acid | 5.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| Methyl Soyate | 4.7% by weight |

TABLE 3a-continued

| | |
|---|---|
| PART C | |
| Water | 19.8% by weight |
| Methocel F4M | 0.7% by weight |

The composition was evaluated as per Example 1. This composition exhibited stripping efficiency comparable to EXAMPLE 1c composition.

Comparative Example 3b

A comparative film removing composition was prepared according to the procedure of Example 1 and using the components of Table 3b.

TABLE 3b

| | |
|---|---|
| PART A | |
| Water | 21.1% by weight |
| Propylene Glycol | 4.0% by weight |
| Glycolic Acid | 5.0% by weight |
| Ethyl Lactate | 2.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| PART C | |
| Water | 21.1% by weight |
| Methocel F4M | 0.7% by weight |

The composition was evaluated as per Example 1. This composition exhibited stripping efficiency triple the time of EXAMPLE 1 composition.

Comparative Example 3c

A comparative film removing composition was prepared according to the procedure of Example 1 and using the components of Table 3c.

TABLE 3c

| | |
|---|---|
| PART A | |
| Water | 22.1% by weight |
| Propylene Glycol | 4.0% by weight |
| Glycolic Acid | 5.0% by weight |
| Hydrogen Peroxide stabilized | 5.0% by weight |
| Ethylan HB-4 | 1.0% by weight |
| Berol TFR | 1.0% by weight |
| PART B | |
| Benzyl Alcohol | 39.0% by weight |
| PART C | |
| Water | 22.1% by weight |
| Methocel F4M | 0.7% by weight |

The composition was evaluated as per Example 1. This composition exhibited stripping efficiency double that of Comparative Example 1c composition.

Example 4

A fourth film removing composition according to the instant disclosure was prepared according to Example 1 using the components of Table 4 and evaluated per Example 1.

| | |
|---|---|
| PART A | |
| Water | 20.5% by weight |
| Propylene Glycol | 4.0% by weight |
| Amino Methyl Propanol-95 | 5.0% by weight |
| Ethyl Lactate | 5.0% by weight |
| PART B | |
| Benzyl Alcohol | 39.0% by weight |
| Methyl Soyate | 5.0% by weight |
| PART C | |
| Water | 20.5% by weight |
| Methocel F4M | 0.7% by weight |

The stripping efficiency of this composition was slightly higher when compared to the results of EXAMPLE 1.

Comparative Example 4a

A comparative film removing composition was prepared according to the procedure of Example 1 and using the components of Table 4a.

TABLE 4a

| | |
|---|---|
| PART A | |
| Water | 20.1% by weight |
| Propylene Glycol | 4.0% by weight |
| Triethanolamine-85% | 5.0% by weight |
| Ethyl Lactate | 5.0% by weight |
| PART B | |
| Benzyl Alcohol | 39.0% by weight |
| Methyl Soyate | 5.0% by weight |
| PART C | |
| Water | 20.1% by weight |
| Methocel F4M | 0.7% by weight |

The composition was evaluated as per Example 1.

The stripping efficiency of this composition almost doubled when compared to EXAMPLE 4 composition.

Comparative Example 4b

A comparative film removing composition was prepared according to the procedure of Example 1 and using the components of Table 4b.

TABLE 4b

| | |
|---|---|
| PART A | |
| Water | 20.13% by weight |
| Propylene Glycol | 4.0% by weight |
| Isopropanolamine | 5.0% by weight |
| Ethyl Lactate | 5.0% by weight |
| PART B | |
| Benzyl Alcohol | 39.0% by weight |
| Methyl Soyate | 5.0% by weight |
| PART C | |
| Water | 20.1% by weight |
| Methocel F4M | 0.7% by weight |

The stripping efficiency of this composition compares to Comparative Example 4a composition. Some attack on wood noted.

Example 5

A fifth film removing composition according to the instant disclosure was prepared according to Example 1 using the components of Table 5 and evaluated per Example 1.

TABLE 5

| | |
|---|---|
| PART A | |
| Water | 20.1% by weight |
| Propylene Glycol | 4.0% by weight |
| Ethanolamine 99% | 5.0% by weight |
| Ethyl Lactate | 5.0% by weight |
| PART B | |
| Benzyl Alcohol | 39.0% by weight |
| Methyl Soyate | 5.0% by weight |
| PART C | |
| Water | 20.1% by weight |
| Methocel F4M | 0.7% by weight |

The stripping efficiency of this composition compares to EXAMPLE 4 composition. Some attack on wood noted.

Comparative Example 5a

A comparative film removing composition was prepared according to the procedure of Example 1 and using the components of Table 5a.

TABLE 5a

| | |
|---|---|
| PART A | |
| Water | 20.1% by weight |
| Propylene Glycol | 4.0% by weight |
| Morpholine | 5.0% by weight |
| Ethyl Lactate | 5.0% by weight |
| PART B | |
| Benzyl Alcohol | 39.0% by weight |
| Methyl Soyate | 5.0% by weight |
| PART C | |
| Water | 20.1% by weight |
| Methocel F4M | 0.7% by weight |

The composition was evaluated as per Example 1. The stripping efficiency of this composition compares to Comparative Example 4a composition.

Comparative Example 5b

A comparative film removing composition was prepared according to the procedure of Example 1 and using the components of Table 5b.

TABLE 5b

| | |
|---|---|
| PART A | |
| Water | 20.1% by weight |
| Propylene Glycol | 4.0% by weight |
| Triethanolamine 85% | 5.0% by weight |
| Hydrogen Peroxide stabilized | 6.0% by weight |
| PART B | |
| Benzyl Alcohol | 39.0% by weight |
| Aromatic 200 | 5.0% by weight |

TABLE 5b-continued

| PART C | |
|---|---|
| Water | 20.1% by weight |
| Methocel F4M | 0.7% by weight |

The composition was evaluated as per Example 1. The resulting composition containing aromatic solvent is slightly less efficient in stripping when compared to composition EXAMPLE 1a and it is not biodegradable.

We claim:

1. A film removal composition, consisting of:

a water insoluble biodegradable alkyl ester;

a water soluble biodegradable alkyl ester;

an activated alcohol;

a peroxide; and a cosolvent selected from the group consisting of water, ethylene glycol, propylene glycol, cyclohexanol, tetrahydrofurfuryl alcohol, N-methylpyrrolidone, dibasic esters of adipic acid, dibasic esters of glutaric acid, dibasic esters of succinic acid, gamma-butyrolactone, substituted lactams, tetramethyl urea, and a combination thereof; and optionally, a member selected from the group consisting of a terpene, a surfactant, a chelating agent, a corrosion inhibitor, a thickening agent, an activator selected from the group consisting of an amine and an acid, and a combination thereof.

2. The composition of claim 1, wherein the water-soluble biodegradable alkyl ester is an alkyl lactate having an alkyl group of from one to three carbons.

3. The composition of claim 1, wherein the water insoluble biodegradable alkyl ester is an alkyl soyate having an alkyl group of from one to fifteen carbons.

4. The composition of claim 1 wherein the water soluble biodegradable alkyl ester is an alkyl lactate having an alkyl group of from one to three carbons, and the water insoluble biodegradable alkyl ester is an alkyl soyate having an alkyl group of from one to fifteen carbons.

5. The composition of claim 4 wherein the alkyl lactate has a number average molecular weight of no more than 175, and the alkyl soyate has a number average molecular weight of at least 104.

6. The composition of claim 5 wherein the alkyl lactate has a number average molecular weight of from 80 to 150, and the alkyl soyate has a number average molecular weight of from 104 to 450.

7. The composition of claim 4 wherein the alkyl lactate has an alkyl group of from one to two carbons.

8. The composition of claim 7 wherein the alkyl lactate is ethyl lactate.

9. The composition of claim 4 wherein the alkyl soyate has an alkyl group of from one to four carbons.

10. The composition of claim 9 wherein the alkyl soyate is methyl soyate.

11. The composition of claim 1, wherein a total weight of the water insoluble biodegradable alkyl ester and the water soluble biodegradable alkyl ester is 1 to 30 percent by weight, based on a total weight of the composition.

12. The composition of claim 11 wherein the water insoluble biodegradable alkyl ester is present in an amount of 40 to 90 percent by weight, and the water soluble biodegradable alkyl ester is present in an amount of 10 to 60 percent by weight, based on the total weight of the water insoluble biodegradable alkyl ester and the water soluble biodegradable alkyl ester.

13. The composition of claim 12, wherein the water insoluble biodegradable alkyl ester is present in an amount of 60 to 80 percent by weight, and the water soluble biodegradable alkyl ester is present in an amount of 20 to 40 percent by weight, based on the total weight of the water insoluble biodegradable alkyl ester and the water soluble biodegradable alkyl ester.

14. The composition of claim 1, wherein the activated alcohol is a substituted or unsubstituted aromatic alcohol.

15. The composition of claim 14, wherein the activated alcohol is benzyl alcohol.

16. The composition of claim 1, wherein the activated alcohol is present in an amount of 1 to 60 percent by weight, based on a total weight of the composition.

17. The composition of claim 16, wherein the activated alcohol is present in an amount of 1 to 30 percent by weight, based on the total weight of the composition.

18. The composition of claim 17, wherein the activated alcohol is present in an amount of 1 to 20 percent by weight, based on the total weight of the composition.

19. The composition of claim 18, wherein the activated alcohol is present in an amount of 2 to 10 percent by weight, based on the total weight of the composition.

20. The composition of claim 1, wherein the peroxide is selected from the group consisting of hydrogen peroxide, urea peroxide, and a combination thereof.

21. The composition of claim 20, wherein the peroxide is hydrogen peroxide.

22. The composition of claim 1, wherein the peroxide is present in an amount of 1 to 50 percent by weight, based on a total weight of the composition.

23. The composition of claim 22, wherein the peroxide is present in an amount of 1 to 40 percent by weight, based on the total weight of the composition.

24. The composition of claim 23, wherein the peroxide is present in an amount of 5 to 25 percent by weight, based on the total weight of the composition.

25. The composition of claim 1 wherein the cosolvent consists of water, and a cosolvent selected from the group consisting of ethylene glycol, propylene glycol, and a combination thereof.

26. The composition of claim 25, wherein the cosolvent consists of water and propylene glycol.

27. The composition of claim 1, wherein the cosolvent is present in an amount of about 1 to about 70 percent by weight, based on a total weight of the composition.

28. The composition of claim 27, wherein the cosolvent is present in an amount of about 5 to about 40 percent by weight, based on the total weight of the composition.

29. The composition of claim 28, wherein the cosolvent is present in an amount of about 10 to about 30 percent by weight, based on the total weight of the composition.

30. The composition of claim 1, wherein the surfactant is selected from the group consisting of a nonionic surfactant, a cationic surfactant, an anionic surfactant, and a combination thereof.

31. The composition of claim 30, wherein the surfactant is a combination of a nonionic surfactant and a cationic surfactant.

32. The composition of claim 1, wherein the thickening agent is selected from the group consisting of hydroxypropyl cellulose, hydroxypropyl methyl cellulose, and a combination thereof.

33. A film removal composition, consisting of:

1 to 30 percent by weight of a combination of a water insoluble biodegradable alkyl ester and a water soluble biodegradable alkyl ester;

1 to 60 percent by weight of an activated alcohol;

1 to 50 percent by weight of a peroxide;

1 to 70 percent by weight of a cosolvent selected from the group consisting of water, ethylene glycol, propylene glycol, cyclohexanol, tetrahydrofurfuryl alcohol, N-methylpyrrolidone, dibasic esters of adipic acid, dibasic esters of glutaric acid, dibasic esters of succinic acid, gamma-butyrolactone, substituted lactams, tetramethyl urea, and a combination thereof;

1 to 20 percent by weight of an activator selected from the group consisting of an amine, an acid, and combinations thereof;

0.01 to 10 percent by weight of a surfactant;

0.1 to 7 percent by weight of a thickening agent;

0.1 to 5 percent by weight of a terpene; and optionally, a member selected from the group consisting of a chelating agent, a corrosion inhibitor, and a combination thereof.

34. The composition of claim 33, wherein the water insoluble biodegradable alkyl ester is present in an amount of 40 to 90 percent by weight, and the water soluble biodegradable alkyl ester is present in an amount of 10 to 60 percent by weight, based on a total weight of the combination of the water insoluble biodegradable alkyl ester and the water soluble biodegradable alkyl ester.

35. The composition of claim 33, wherein the activated alcohol is present in an amount of 1 to 20 percent by weight, and the peroxide is present in an amount of 5 to 25 percent by weight, based on the total weight of the composition.

36. A film removal composition, consisting of:

1 to 30 percent by weight of a combination of a water insoluble biodegradable alkyl ester and a water soluble biodegradable alkyl ester, wherein the water soluble biodegradable alkyl ester is an alkyl lactate having an alkyl group of from one to three carbons, and the water insoluble biodegradable alkyl ester is an alkyl soyate having an alkyl group of from one to fifteen carbons, and further wherein the water insoluble biodegradable alkyl ester is present in an amount of 40 to 90 percent by weight, and the water soluble biodegradable alkyl ester is present in an amount of 10 to 60 percent by weight, based on a total weight of the combination of the water insoluble biodegradable alkyl ester and the water soluble biodegradable alkyl ester;

1 to 60 percent by weight of an activated alcohol, selected from the group consisting of a substituted aromatic alcohol and an unsubstituted aromatic alcohol;

1 to 50 percent by weight of a peroxide selected from the group consisting of hydrogen peroxide, urea peroxide, and a combination thereof;

1 to 70 percent by weight of a cosolvent selected from the group consisting of water, ethylene glycol, propylene glycol, and a combination thereof;

1 to 20 percent by weight of an activator selected from the group consisting of an amine, an acid, and a combination thereof;

0.01 to 10 percent by weight of a surfactant selected from the group consisting of a nonionic surfactant, a cationic surfactant, an anionic surfactant, and a combination thereof;

0.1 to 7 percent by weight of a thickening agent selected from the group consisting of hydroxypropyl cellulose, hydroxypropyl methyl cellulose, and a combination thereof;

0.1 to 5 percent by weight of a terpene; and optionally, a member selected from the group consisting of a chelating agent, a corrosion inhibitor, and a combination thereof.

37. A film removal composition, consisting of:

1 to 30 percent by weight of a combination of ethyl lactate and methyl soyate, wherein the ethyl lactate is present in an amount of 40 to 90 percent by weight, and the methyl soyate is present in an amount of 10 to 60 percent by weight, based on a total weight of the combination of ethyl lactate and methyl soyate;

1 to 60 percent by weight of benzyl alcohol;

1 to 50 percent by weight of hydrogen peroxide;

1 to 70 percent by weight of a cosolvent selected from the group consisting of water, propylene glycol, and a combination thereof;

1 to 20 percent by weight of an activator selected from the group consisting of an amine, an acid, and a combination thereof;

0.01 to 10 percent by weight of a surfactant selected from the group consisting of a nonionic surfactant, a cationic surfactant, an anionic surfactant, and a combination thereof;

0.1 to 7 percent by weight of a thickening agent selected from the group consisting of hydroxypropyl cellulose, hydroxypropyl methyl cellulose, and a combination thereof;

0.1 to 5 percent by weight of a terpene.

* * * * *